US005133502A

United States Patent [19]

Bendig et al.

[11] Patent Number: 5,133,502

[45] Date of Patent: Jul. 28, 1992

[54] FLAT-JET NOZZLE TO ATOMIZE LIQUIDS INTO COMPARATIVELY COARSE DROPS

[75] Inventors: Lothar Bendig, Pfullingen; Ulrich Allagier, Kusterdingen-Wankheim; Helmut Wenzel, Bad Urach-Wittlingen, all of Fed. Rep. of Germany

[73] Assignee: Lechler GmbH & Co., Fellbach, Fed. Rep. of Germany

[21] Appl. No.: 510,630

[22] Filed: Apr. 18, 1990

[30] Foreign Application Priority Data

May 3, 1989 [DE] Fed. Rep. of Germany ..... 3914551

[51] Int. Cl.[5] ..... B05B 1/04; B05B 1/34

[52] U.S. Cl. ..... 239/504; 239/524; 239/590.3; 239/599

[58] Field of Search ..... 239/504, 518, 590, 590.3, 239/599, 524, 580

[56] References Cited

U.S. PATENT DOCUMENTS

| | | | |
|---|---|---|---|
| 1,863,914 | 6/1932 | Tyler | 239/524 X |
| 2,522,928 | 9/1950 | Carroll | 239/590.3 |
| 2,774,631 | 12/1956 | Wahlin | 239/590.3 |
| 3,858,812 | 1/1975 | Williams et al. | 239/599 |
| 4,097,000 | 6/1978 | Derr | 239/599 |
| 4,128,206 | 12/1978 | Bintner | 239/590 X |
| 4,380,319 | 4/1983 | Shigut | 239/590.3 X |
| 4,655,395 | 4/1987 | Cioffi et al. | 239/518 X |

FOREIGN PATENT DOCUMENTS

| | | | |
|---|---|---|---|
| 1009516 | 4/1983 | U.S.S.R. | 239/518 |

*Primary Examiner*—Andres Kashnikow
*Assistant Examiner*—William Grant
*Attorney, Agent, or Firm*—Shlesinger Arkwright & Garvey

[57] ABSTRACT

A flat-jet nozzle for atomizing liquids into comparatively large drops and comprising a nozzle housing with an axial feed passing through it with a multiple stepped diameter, this feed being provided at its end with a nozzle discharge slit. Moreover an inset with a central throttling bore is mounted in the liquid feed between the liquid intake and the discharge slit. A cylindrical central zone of a larger diameter than the discharge slit is present in the liquid feed in the nozzle housing. The inset is provided with a deflector through which the liquid jet issuing from the throttling bore into the central zone is forced, preferably bilaterally, toward the large axis of the nozzle discharge slit.

10 Claims, 3 Drawing Sheets

FLAT-JET NOZZLE TO ATOMIZE LIQUIDS INTO COMPARATIVELY COARSE DROPS

FIELD OF THE INVENTION

The invention relates to a flat-jet nozzle for atomizing liquids into relatively coarse drops.

BACKGROUND OF THE INVENTION

When atomizing plant protectants with low discharge rates, lubricant oils and other substances which because of their toxicity may endanger the environment, it is necessary to prevent drifts into areas not to be sprayed. The danger of the atomized liquid drifting inherently increases the smaller the drop size. When atomizing liquids in the above applications, it is necessary therefore to achieve a fairly coarse drop spectrum. On the other hand uniform spraying of the intended areas demands as uniform a liquid distribution as possible.

The insight of the present state of the art is that the drop spectrum generated by a flat-jet nozzle shall be the finer the smaller the nozzle and hence the discharge rate. This means that when atomizing small amounts of ecologically stressful substances, the danger of small drops drifting will be real. As already indicated, such undesired drifting practically takes place foremost when highly concentrated plant protectants are discharged, and in particular when applying lubricant oils.

A further relation exists in that the drop spectrum of a single nozzle becomes finer as the pressure increases. Accordingly if the drop sizes are to be increased, the lowest pressure and the largest nozzle should be selected. While it is possible in this manner to achieve—to some extent—a coarse drop spectrum, there is failure on the other hand to meet the equally important requirement of uniform liquid distribution.

The U.S. Pat. No. 3,858,812 discloses a flat-jet nozzle of the initially cited kind and designed for low pressures. This known nozzle comprises a stepped liquid-guide means (borehole) which however assumes an oval shape at the liquid intake in order to affect the liquid distribution. In one embodiment mode this feature is implemented by means of a pane with oval borehole pressed into the nozzle. The purpose of this intake geometry is to correct a liquid distribution with excess emphasis on the edges. The large axis of the borehole oval is perpendicular to the large axis of the discharge slit, whereby the liquid is forced away from the edges and is more concentrated toward the center.

The oval borehole in the pane-like inset of the known nozzle lacks a throttling effect on the volumetric flow, at least it is not explicitly intended. As a result, the known features of U.S. Pat. No. 3,858,812 do not allow significantly controlling the drop spectrum in the sense of the desired increase in drop size.

OBJECTS AND SUMMARY OF THE INVENTION

Based on the stated art, it is the object of the present invention to create a flat-jet nozzle capable of atomizing a liquid at low pressures, preferably in the range between 1 and 5 bars, so as to form coarse drops, while retaining highly uniform distribution of liquid.

While the European patent document 0037 747 A1 discloses an inset for the purpose of throttling the liquid flow, this design—which deviates from the species of the present invention—concerns a triple-hole nozzle. In other words, the known nozzle comprises three cylindrical boreholes to generate three solid jets of which the diameters are determined solely by the size of the discharge bore. Moreover the purpose of the inset in the known nozzle is merely to restrict the most narrow cross-section of the nozzle to a single borehole for reasons of wear palliation.

As regards the flat-jet nozzle of the invention on the other hand, the pressure is throttled by an inset ahead of the nozzle discharge slit and simultaneously the liquid jet is so expanded toward the large axis of the discharge slit that the liquid is forced into edge zones of the discharge slit. There, at the discharge edges, the liquid is much deflected by detachment (eddying), and as a result a large jet angle is produced. Accordingly the invention achieves a coarse drop spectrum (because of the low pressure in the nozzle) at equal jet angle and uniform liquid distribution.

BRIEF DESCRIPTION OF THE DRAWINGS

Illustrative embodiments shown in the drawings and described below serve to elucidate the invention.

DETAILED DESCRIPTION OF THE PREFERRED EMBODIMENTS

Figure 1:
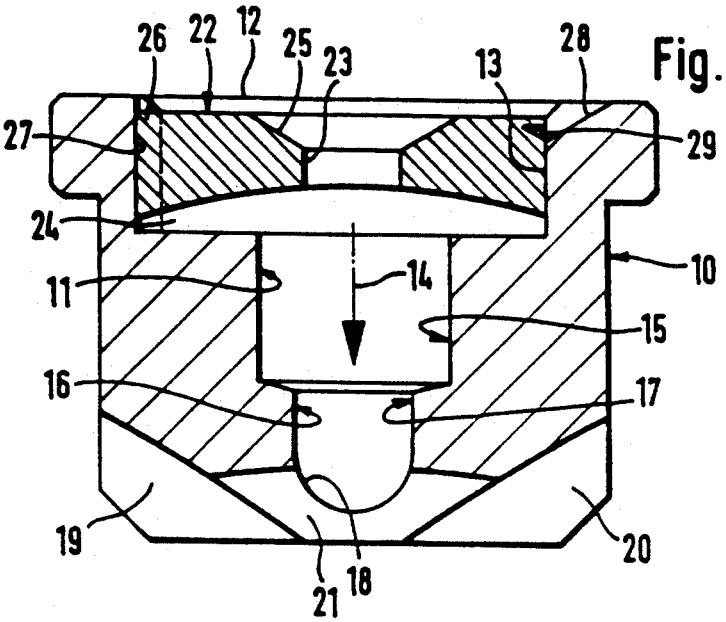
FIG. 1 is a vertical longitudinal section of a flat-jet nozzle of the invention.

In FIGS. 1 and 3 through 5, 10 denotes a cylindrical nozzle housing with a continuous, center liquid feed 11 which is stepped several times. The liquid feed 11 starts at the upper end of the nozzle housing 11, at the liquid intake 12, having a maximum diameter in the zone 13, this diameter passing stepwise in the direction of flow 14 into a central zone 15 of lesser diameter. The central zone 15 is followed coaxially by a so-called discharge geometry 16 evincing a diameter even less than the central zone 15 of the liquid feed 11. The discharge geometry 16 consists of a cylindrical segment 17 and of a following, as seen in the direction of flow 14, adjoining terminal segment 18 of approximate spherical shape. Two side clearances 19, 20 and a prismatic milling 21 are present at the lower end of the nozzle housing 10. The prismatic milling 21 intersects the discharge geometry 16 and forms the nozzle discharge.

Figure 2:
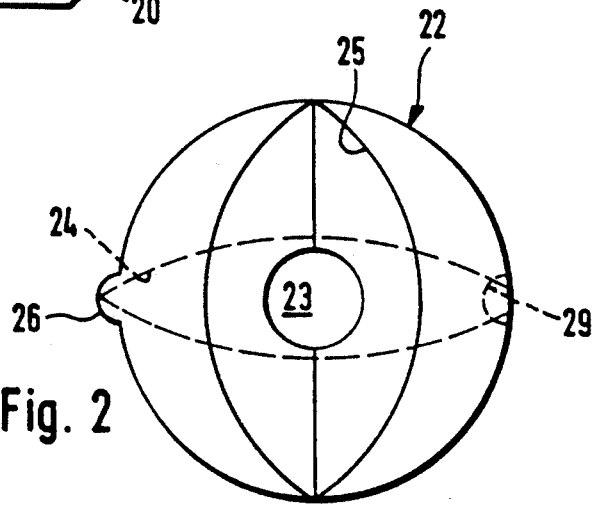
FIG. 2 is a topview of the inset of the nozzle of FIG. 1, FIGS. 3 through 5 are sections corresponding to FIG. 1 of further modes of the invention.

A cylindrical inset denoted as a whole by 22 is mounted in the upper zone 13 of the liquid feed 11 of FIGS. 1 and 2 and comprises a central throttling bore 23 determining the volumetric flow through the nozzle. A slotted milling 24 (the so-called functional prismatic milling) is present at the lower side of the inset 22 and intersects the throttling bore 23. The functional prismatic milling 24 is parallel to the nozzle discharge slit 21. Another slotted milling 25 is present in the inset 22 at the top and also intersects the throttling bore 23. As shown by FIG. 2, the second slotted milling 25 is orthogonal to the functional prismatic milling 24.

The above described alignment of the slotted millings 24, 25 relative to the nozzle discharge slit 21 requires a corresponding assembly position of the inset 22 in the nozzle housing 10. For that purpose the inset 10 is provided with a side beak 26 matching a corresponding clearance 27 in the nozzle housing 10.

Furthermore a clearance 28 is present in the nozzle housing 10 and is associated with a clearance 29 in the inset 22. The clearances 28, 29 are used to assemble and disassemble the inset 22 using suitable tools.

By means of the said elements, namely the beak 26 at the inset 22 and the clearance 27 in the nozzle housing 10, both accurate positioning of the inset 22 and its irrotational seating in the nozzle housing 10 are assured. However, as an alternative, the inset 22 also may be press-fitted into the nozzle housing 10. In that event elements 26 through 29 may be eliminated.

On account of the two mutually orthogonal slotted millings 24 and 25, the inset 22 is endowed with the function of a flat-jet nozzle. In other words, the throttled liquid jet passing from the throttling bore 23 into the lower milling 24 of the inset 22 is expanded toward the large axis of the nozzle discharge slit 21 and as such arrives into the central zone 15 of the liquid feed 11. Whereas the throttling achieves a commensurately lower pressure and thereby the physical pre-condition for making coarse drops, the said expansion of the liquid jet provides the condition for a large jet angle with uniformly distributed jet of liquid at the nozzle discharge slit 21.

The above described effect of the invention is enhanced if the nozzle per se, that is without the inset 22, evinces a liquid distribution bunching at the center.

Figure 3:
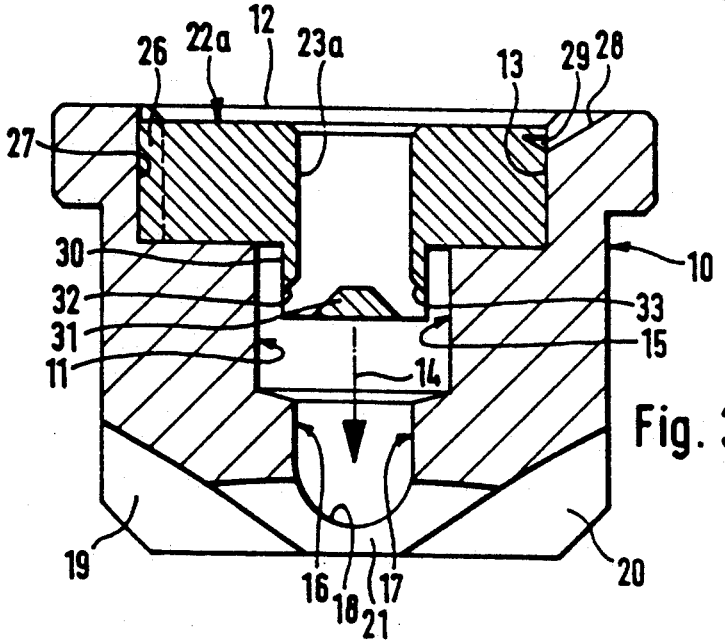

The nozzle of FIG. 3 differs from the above embodiment mode of FIGS. 1 and 2 by a different structure of the inset denoted in FIG. 3 by 22*a*. The inset 22*a* comprises at its lower end a journal-like extension 30 with a frustoconical impact disk 31 at its lower end. The throttling bore 23 passing through the inset 22*a* and expanding at its lower end is divided by this frustoconical impact disk 31 into two diverging, partial bores 32 and 33. The partial bores 32, 33 and correspondingly the partial liquid flows passing through them are aligned toward the large axis of the nozzle discharge slit 21. The function of the inset 22*a* of FIG. 3 essentially corresponds to that of the inset 22 of FIG. 1.

Figure 4:
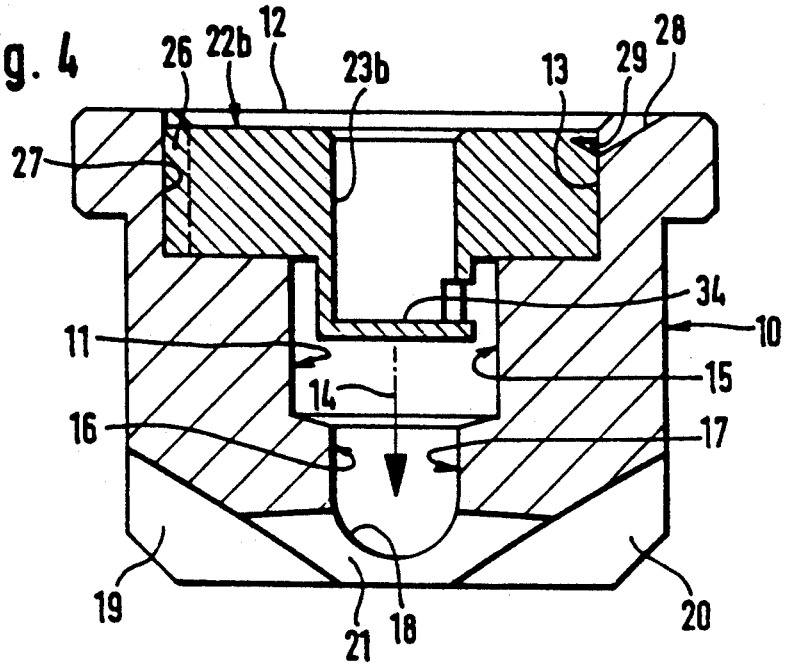

In the embodiment mode of FIG. 4, the inset is denoted by 22*b*. The specialty here is that a plane impact disk 34 follows the throttling bore 23*b* as seen in the direction of flow. Again the function in this case corresponds to that of FIGS. 1 through 3 (see above).

Figure 5:
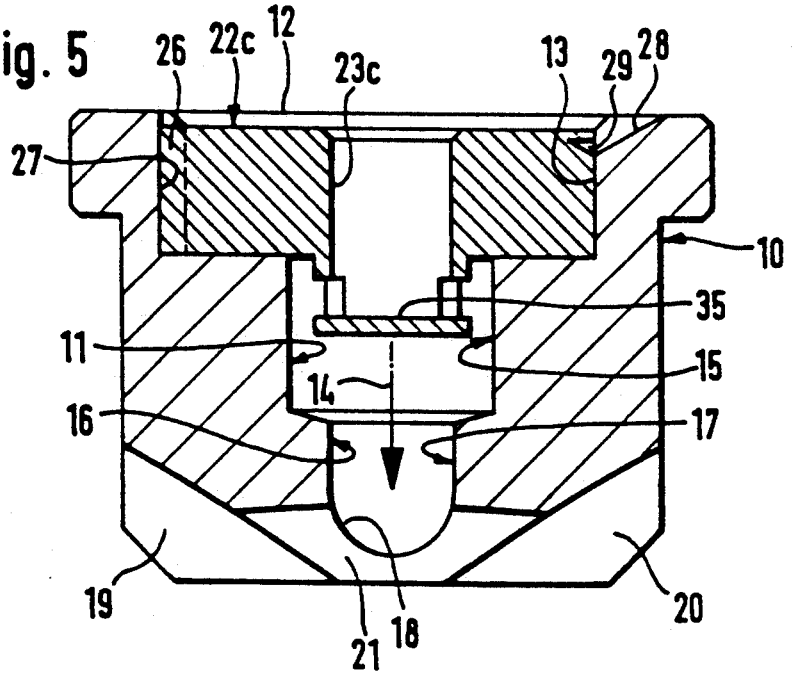

In the embodiment shown in FIG. 5, the inset denoted therein by 22*c* is special in that the throttling bore 23*c* coaxial with the liquid feed 11 issues by its discharge end inside the inset 22*c* into a continuous cross-bore 35. By means of the cross-bore 35 pointing toward the large axis of the nozzle discharge slit 21, the liquid jet is deflected at right angles in both directions and split in two. The function of these deflecting means corresponds to that of the deflecting means of the embodiment modes of FIGS. 1 through 4.

Figure 6:
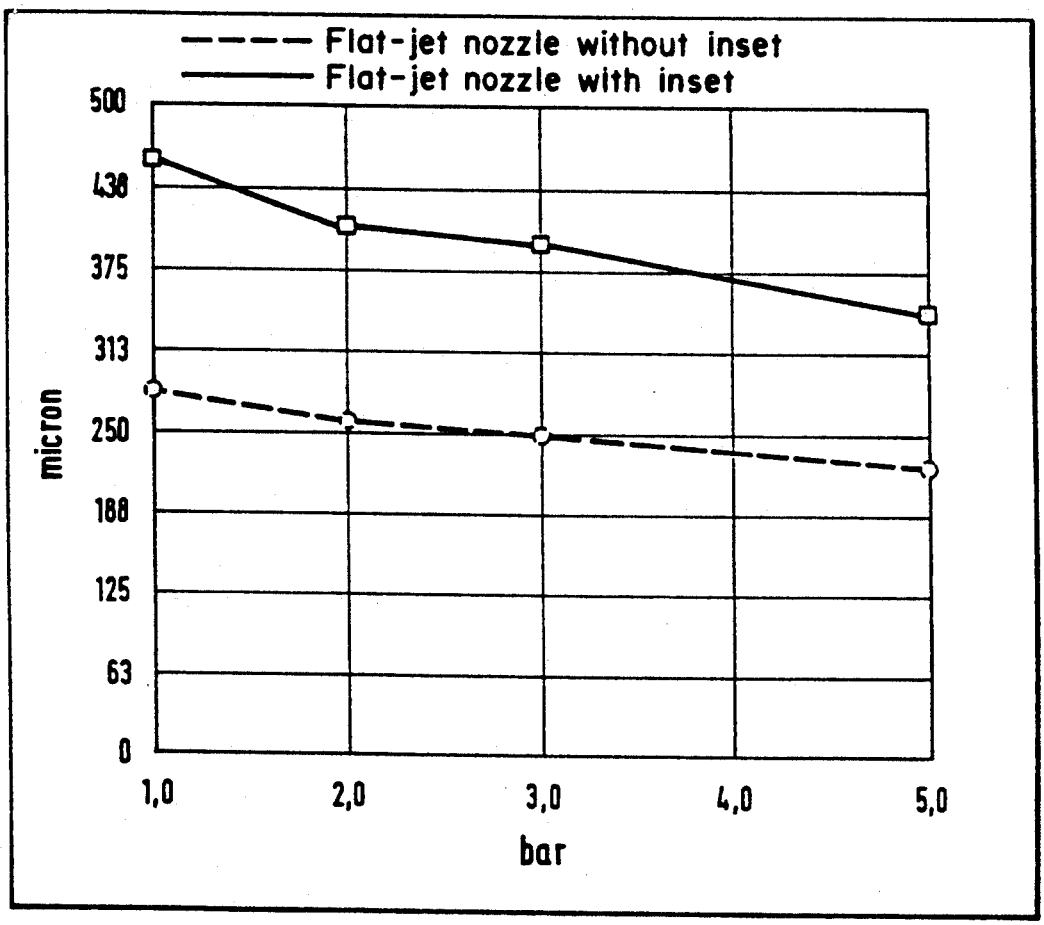
FIG. 6 is a plot of the mean drop size made possible by the flat-jet nozzles of the invention, for instance according to FIGS. 1 through 5, as a function of the nozzle intake pressure.

FIG. 6 is a plot of the coarse drop spectrum which is made possible by the nozzle of the invention, for instance by means of the embodiments of FIGS. 1 through 5. The mean drop diameter—the so-called Sauter diameter—is shown in microns against the nozzle intake pressure in bars. The characteristic of the nozzle of the invention is shown by the upper, thick solid curve. (The Sauter diameter is the mean value characterizing the ratio of drop volume to drop surface).

For comparison, the plot shows a dashed line representing the characteristic of a "normal" flat-jet nozzle without the inset of the invention. The advantages offered by the nozzle of the invention are made especially clear thereby. As a result, an increase of the mean drop diameter of about 70% is made possible by the invention.

We claim:

1. A flat-jet nozzle for atomizing liquids into comparatively coarse drops, comprising:

a) a nozzle housing having an axially continuous liquid guide, said liquid guide having a liquid intake and a liquid outlet and a central cylindrical zone forming a differential pressure chamber between said intake and said outlet;

b) said liquid guide having a discharge slit at said outlet;

c) an inset mounted in said liquid guide between said intake and said central cylindrical zone;

d) said inset having a throttling bore;

e) said inset including deflecting means formed by a first prismatic milling facing the liquid intake and a second prismatic milling facing the liquid outlet, said first and second millings being orthogonal to each other;

f) said chamber having a wider diameter than said nozzle discharge zone and said bore;

g) said second prismatic milling is in alignment with the longitudinal axis of said discharge slit; and, h) said inset includes a laterally extending portion corresponding to a lateral clearance in said nozzle housing to facilitate alignment of said inset with respect to said nozzle housing.

2. The flat-jet nozzle as set forth in claim 1, wherein:

a) said inset is mounted directly at said liquid intake of said nozzle housing and is formed corresponding to said liquid guide.

3. The flat-jet nozzle as set forth in claim 1, wherein:

a) said inset includes a first clearance mounted diametrically to said laterally extending portion and corresponds to a second clearance located in said nozzle housing.

4. A flat-jet nozzle for atomizing liquids into comparatively coarse drops, said nozzle comprising:

a) a nozzle housing having an axially continuous liquid guide, said liquid guide having a liquid intake and a liquid outlet and a central cylindrical zone forming a differential pressure chamber between said intake and said outlet;

b) said liquid guide having a discharge slit at said outlet;

c) an inset mounted in said liquid guide between said intake and said central cylindrical zone;

d) said inset having a throttling bore;

e) said inset includes deflecting means formed by flaring of said throttling bore at the liquid intake and a centrally mounted impact disk facing the liquid outlet for forming a divided fluid flow from the throttling bore into said central cylindrical zone and diverging in the direction of the longitudinal axis of said discharge slit; and, f) said inset includes a laterally extending portion corresponding to a lateral clearance in said nozzle housing to facilitate alignment of the diverging fluid flow with respect to the longitudinal axis of said discharge slit.

5. The flat-jet nozzle as set forth in claim 4, wherein:

a) said inset is mounted directly at said liquid intake of said nozzle housing and is formed corresponding to said liquid guide.

6. The flat-jet nozzle as set forth in claim 4, wherein:

a) said inset includes a first clearance mounted diametrically to said laterally extending portion and corresponds to a second clearance located in said nozzle housing.

7. A flat-jet nozzle for atomizing liquids into comparatively coarse drops, said nozzle comprising:

a) a nozzle housing having an axially continuous liquid guide, said liquid guide having a liquid intake and a liquid outlet and a central cylindrical zone forming a differential pressure chamber between said intake and said outlet;

b) said liquid guide having a discharge slit at said outlet;

c) an inset mounted in said liquid guide between said intake and said central cylindrical zone;

d) said inset having a throttling bore;

e) said chamber having a wider diameter than said nozzle discharge zone and said throttling bore;

f) said inset including liquid flow deflecting means having a planar impact disk abutting said throttling bore whereby the liquid flow issuing from the throttling bore into said chamber is deflected in the direction of the longitudinal axis of said nozzle discharge slit;

g) said inset includes a laterally extending portion corresponding to a lateral clearance in said nozzle housing to facilitate alignment of said inset with respect to said nozzle housing and, h) said inset includes a first clearance mounted diametrically to said laterally extending portion and corresponds to a second clearance located in said nozzle housing.

8. The flat-jet nozzle as set forth in claim 7, wherein:

a) said inset is mounted directly at said liquid intake of said nozzle housing and is formed corresponding to said liquid guide.

9. A flat-jet nozzle for atomizing liquids into comparatively coarse drops, said nozzle comprising:

a) a nozzle housing having an axially continuous liquid guide, said liquid guide having a liquid intake and a liquid outlet and a central cylindrical zone forming a differential pressure chamber between said intake and said outlet;

b) said liquid guide having a discharge slit at said outlet;

c) an inset mounted in said liquid guide between said intake and said central cylindrical zone;

d) said inset having a throttling bore;

e) said chamber having a wider diameter than said nozzle discharge zone and said throttling bore;

f) said inset includes a deflecting means having a continuous cross-bore formed substantially perpendicularly to said throttling bore, said cross-bore includes a pair of outlets through which liquid flowing through said throttling bore is caused to diverge in the direction of the longitudinal axis of said nozzle discharge slit;

g) said inset includes a laterally extending portion corresponding to a lateral clearance in said nozzle housing to facilitate alignment of said inset with respect to said nozzle housing, and h) said inset includes a first clearance mounted diametrically to said laterally extending portion and corresponds to a second clearance located in said nozzle housing.

10. The flat-jet nozzle as set forth in claim 9, wherein:

a) said inset is mounted directly at said liquid intake of said nozzle housing and is formed corresponding to said liquid guide.

* * * * *